United States Patent [19]

Perry

[11] Patent Number: 4,573,598

[45] Date of Patent: Mar. 4, 1986

[54] CHILD-RESISTANT PACKAGE WITH TAMPER INDICATING DEVICE

[75] Inventor: Robert A. Perry, Toledo, Ohio

[73] Assignee: Owens-Illinois, Inc., Toledo, Ohio

[21] Appl. No.: 728,417

[22] Filed: Apr. 29, 1985

[51] Int. Cl.[4] ..... H61J 1/00; B65D 55/02; B65D 85/56

[52] U.S. Cl. ..... 215/204; 215/225; 215/256; 215/251

[58] Field of Search ..... 215/204, 206, 216, 219, 215/223, 224, 225, 251, 256

[56] References Cited

U.S. PATENT DOCUMENTS

| | | | |
|---|---|---|---|
| 4,280,631 | 7/1981 | Lohrman | 215/204 |
| 4,511,051 | 4/1985 | Desai | 215/225 |
| 4,522,307 | 6/1985 | Steiner | 215/219 |

*Primary Examiner*—George T. Hall
*Attorney, Agent, or Firm*—John R. Nelson

[57] ABSTRACT

A child-resistant package with a snap-on closure comprising a container having a neck finish including an annular retaining bead having at least one notch therein and a closure having a top and a peripheral skirt. The skirt has a lifting tab on the outer surface thereof and a first radially inwardly extending locking lug on the inner surface thereof adjacent the external lifting tab. A cover cap having a top wall and a peripheral wall is placed over the closure and the peripheral wall of the cover surrounds the peripheral skirt of the closure. An annular band is connected to the lower edge of the peripheral wall of the cover cap by weakened portions. The band includes a plurality of circumferentially spaced radially inwardly extending lugs that project beneath the free edge of the peripheral skirt of the closure so that the cover cap cannot be removed until the band is first removed by severing it from the closure cap. The band normally obscures the view of the indicia on the container that indicates proper alignment of the lug on the closure with the notch on the container. The cover cap normally obscures the view of the construction and indicia on the closure.

16 Claims, 5 Drawing Figures

CHILD-RESISTANT PACKAGE WITH TAMPER INDICATING DEVICE

This invention relates to child-resistant packages and particularly child-resistant packages of the snap-on closure type.

BACKGROUND AND SUMMARY OF THE INVENTION

One common type of child-resistant closure that has been utilized is the arrangement as shown in U.S. Pat. Nos. 3,871,662 and 4,375,859 wherein the container has an annular bead thereon with at least one notch therein and the closure has a locking lug on the skirt thereof which must be brought into alignment with a notch to remove the closure by an upward force.

It has heretofore been suggested that a tamper indicating band can be provided in such a package by having a tamper indicating tab formed on the closure with a radially inwardly extending lug such that when the locking lug is aligned with a notch in the bead the closure cannot be removed until the tab portion of the band is severed from the skirt of the closure. Such an arrangement is disclosed and claimed in the copending application Kirit C. Desai, Ser. No. 612,498, filed May 21, 1984, having a common assignee with the present application.

Among the objectives of the present invention are to provide a tamper indicating device for such child-resistant packages which is of a different type and which is low in cost and can be readily adapted to child-resistant packages of the aforementioned type.

In accordance with the invention, a child-resistant package with a snap-on closure comprises a container having a neck finish including an annular retaining bead having at least one notch therein and a closure having a top and a peripheral skirt, the skirt having a lifting tab on the outer surface thereof and a first radially inwardly extending locking lug on the inner surface thereof adjacent the external lifting tab. A cover cap having a top wall and a peripheral wall is placed over the closure and the peripheral wall of the cover surrounds the peripheral skirt of the closure. An annular band is connected to the lower edge of the peripheral wall of the cover cap by weakened portions. The band includes a plurality of circumferentially spaced radially inwardly extending lugs that project beneath the free edge of the peripheral skirt of the closure so that the cover cap cannot be removed until the band is first removed by severing it from the closure cap. The band normally obscures the view of the indicia on the container that indicate proper alignment of the lug on the closure with the notch on the container. The cover cap normally obscures the view of the construction and indicia on the closure.

DESCRIPTION

Figure 1:
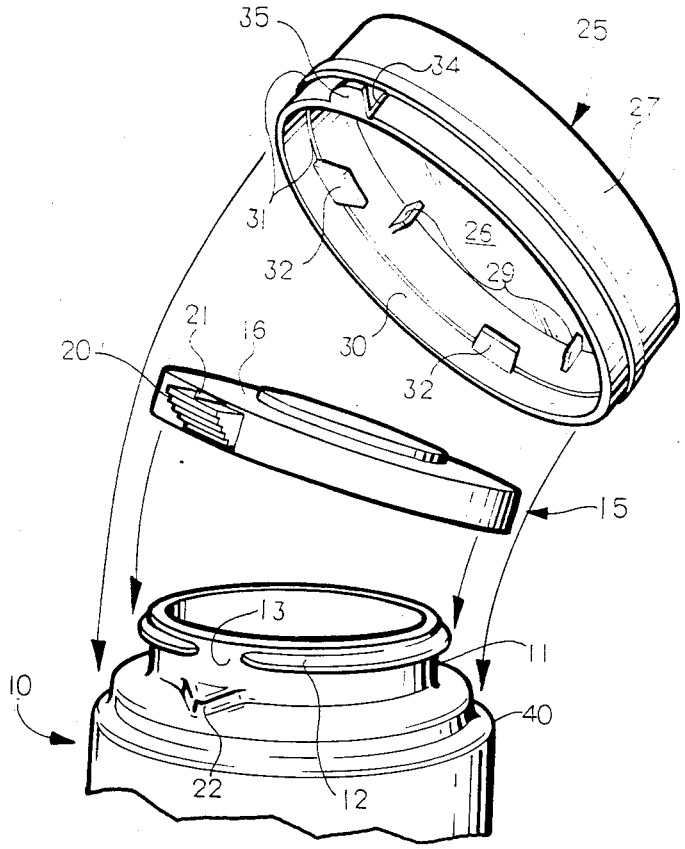
FIG. 1 is a fragmentary exploded perspective view of the child-resistant package embodying the invention.
Figure 4:
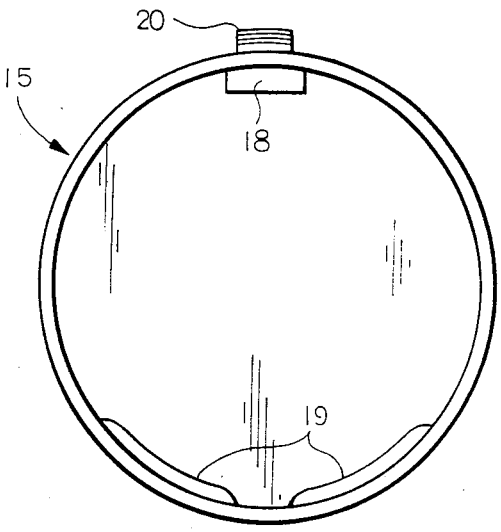
FIG. 4 is a bottom plan view of the closure utilized in the child-resistant package.
Figure 5:
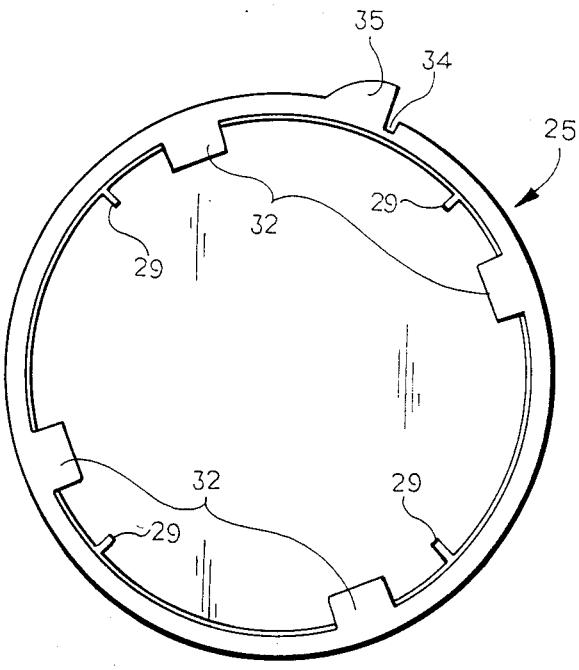
FIG. 5 is a bottom plan view of the cover utilized in the child-resistant package.
Figure 2:
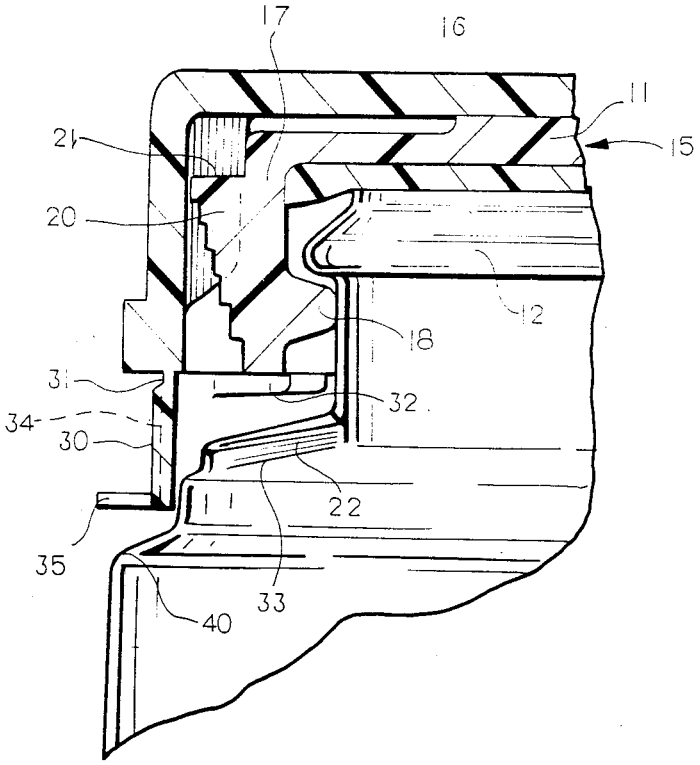
FIG. 2 is a fragmentary vertical sectional view on an enlarged scale.
Figure 3:
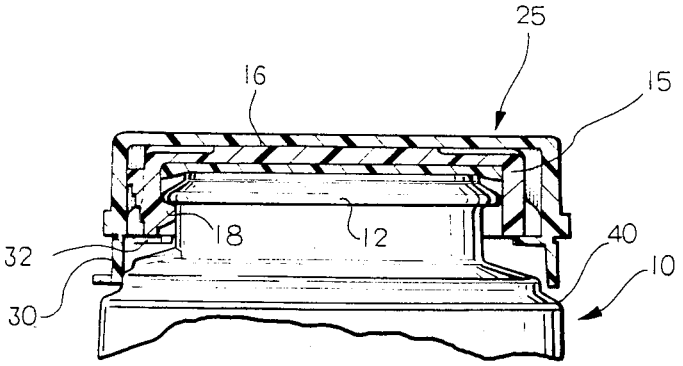
FIG. 3 is a vertical sectional view.

Referring to FIGS. 1–3, the child-resistant package is of conventional construction in that it includes a container 10 made of glass or plastic having a neck 11 with at least one arcuate interrupted bead 12 and notch 13 in the periphery of the bead 12. A plastic closure 15 includes a top wall 16 and a peripheral skirt 17. A first locking lug 18 extends circumferentially on the inside of skirt 17 of the closure 15 and is adapted to engage below the bead 12. A pair of locking lugs 19 are also provided on the inside of skirt 17 and are adapted to engage beneath the bead 12. A lifting tab 20 is provided on the exterior of the skirt 17 circumferentially aligned with locking lug 18. When lug 18 is aligned with the notch 13, then the closure 15 can be removed by an upward tilting movement on the lifting tab 20. Complementary indicia 21, 22 such as arrows are provided on the closure 15 and container 10, respectively, to indicate the proper alignment.

In accordance with the invention a tamper indicating device is provided which includes a plastic cover cap 25 having a top wall 26 and a peripheral wall 27 which is telescoped over the top wall 26 and peripheral skirt 17 of the closure 15. The peripheral wall 27 of the cover cap 25 includes a plurality of axially extending and radially inwardly extending ribs 29 which center the cover cap 25 over the closure 15. The ribs 29 have a greater dimension axially and radially than the thickness in a circumferential direction. The number of ribs 29 is at least four.

In addition, the cover cap 25 includes a band 30 on the lower edge of the peripheral wall 27 thereof which is connected to the peripheral wall by weakened portions 31 such as a thin membrane or a plurality of bridges. The band 30 includes integral, radially inwardly extending, circumferentially spaced flexible tabs 32 that extend below the free edge of the skirt 17 of the closure 15. The tabs 32 have a greater dimension circumferentially and radially than the thickness axially.

Container 10 includes a first shoulder 33 on which indicia 22 on the container is provided. The container 10 also includes a second shoulder 40. The band extends axially toward shoulder 40 to obscure the view of the indicia 22.

After the closure 15 is applied to the container 10, the cover cap 25 is placed over the closure and the tab 32 snaps below the free edge of the skirt 17 of the closure 15.

The band 30 then normally obscures the view of the indicia 22 on the container and the cover cap 25 prevents view of the instructions or other indicia on the top wall 16 of the closure 15.

In order to facilitate removal of the band, it may have a vertical weakened line or portion 34 and a tab 35 for grasping the band for removal.

When it is desired to gain access to the contents of the package, the band 30 is severed along the weakened line 34 exposing the indicia and removing the ribs 32 from beneath the free edge of the skirt 17 so that the cap 25 can be removed and this, in turn, will permit viewing of the instructions and indicia on the closure.

I claim:

1. A child-resistant package with a snap-on closure comprising a container having a neck finish including an annular retaining bead having at least one notch therein, a closure having a top and a peripheral skirt, the skirt having a lifting tab on the outer surface thereof and a first radially inwardly extending locking lug on the inner surface thereof adjacent the external lifting tab, a cover cap having a top wall and a peripheral wall placed over the closure, the peripheral wall of the cover surrounding the peripheral skirt of the closure, an annular band connected to the lower edge of the peripheral wall of the cover cap by weakened portions, said band including a plurality of circumferentially spaced radially inwardly extending lugs that project beneath the free edge of the peripheral skirt of the closure so that the cover cap cannot be removed until the band is first removed by severing it from the closure cap, indicia on the container and said closure that indicates proper alignment of the lug on the closure with the notch on the container, said band normally obscuring the view of the indicia, said cover cap normally obscuring viewing of the indicia on the closure.

2. The child-resistant package set forth in claim 1 wherein said container includes a first shoulder on which indicia is located.

3. The child-resistant package set forth in claim 2 wherein said container includes a second shoulder spaced axially from said first shoulder and spaced radially outwardly from said first shoulder, said band extending adjacent said second shoulder and obscuring the view of said indicia.

4. The child-resistant package set forth in claim 1 including an axial weakened line on said band.

5. The child-resistant package set forth in claim 4 including a gripping tab adjacent said weakened line.

6. The child-resistant package set forth in any of claims 1–5 wherein said cap includes a plurality of circumferentially spaced radially inwardly extending ribs for centering the cap on the closure.

7. The child-resistant package set forth in claim 6 wherein each said rib on said cap has a dimension axially and radially which is greater than the thickness in a circumferential direction.

8. The child-resistant package set forth in any of claims 1–5 wherein each said tab on said band has a greater dimension circumferentially and radially than the thickness axially.

9. The child-resistant package set forth in claims 1–5 wherein said cap includes a plurality of circumferentially spaced radially outwardly extending ribs for centering the cap on the closure, each said rib on said cap having a dimension axially and radially which is greater than the thickness in a circumferential direction, each said tab in said band has a greater dimension circumferentially radially than the thickness axially.

10. For use with a child-resistant package with a snap-on closure comprising a container having a neck finish including an annular retaining bead having at least one notch therein, a closure having a top and a peripheral skirt, the skirt having a lifting tab on the outer surface thereof and a first radially inwardly extending locking lug on the inner surface thereof adjacent the external lifting tab, a cover cap having a top wall and a peripheral wall placed over the closure, the peripheral wall of the cover surrounding the peripheral skirt of the closure, an annular band connected to the lower edge of the peripheral wall of the cover cap by weakened portions, said band including a plurality of circumferentially spaced radially inwardly extending lugs that project beneath the free edge of the peripheral skirt of the closure so that the cover cap cannot be removed until the band is first removed by severing it from the closure cap, indicia on the container and said closure that indicates proper alignment of the lug on the closure with the notch on the container, said band normally obscuring the view of the indicia, said cover cap normally obscuring viewing of the indicia on the closure.

11. The cover cap set forth in claim 10 including an axial weakened line on said band.

12. The cover cap set forth in claim 11 including a gripping tab adjacent said weakened line.

13. The cover cap set forth in claims 10–12 wherein said cap includes a plurality of circumferentially spaced radially inwardly extending ribs for centering the cap on the closure.

14. The cover cap set forth in claim 13 wherein each said rib on said cap has a dimension axially and radially which is greater than the thickness in a circumferential direction.

15. The cover cap set forth in claims 10–12 wherein each said tab on said band has a greater dimension circumferentially and radially than the thickness axially.

16. The cover cap set forth in claims 10–12 wherein said cap includes a plurality of circumferentially spaced radially inwardly extending ribs for centering the cap on the closure, each said rib on said cap having a dimension axially and radially which is greater than the thickness in a circumferential direction, each said tab in said band has a greater dimension circumferentially radially than the thickness axially.

* * * * *